United States Patent [19]

Kida

[11] Patent Number: 4,474,200

[45] Date of Patent: Oct. 2, 1984

[54] UMBRELLA WITH OVAL CANOPY

[76] Inventor: Nobutoshi Kida, 398-57, Higashi-ikoma 3-chome, Ikoma, Nara 630-02, Japan

[21] Appl. No.: 410,001

[22] Filed: Aug. 20, 1982

[30] Foreign Application Priority Data

Mar. 19, 1982 [JP] Japan ..... 57-44901

[51] Int. Cl.[3] ..... A45B 11/00

[52] U.S. Cl. ..... 135/20 R

[58] Field of Search ..... 135/20 R, 20 A, 25, 135/26, 31

[56] References Cited

U.S. PATENT DOCUMENTS 1,168,427 1/1916 Saraniecki ..... 135/26
1,299,877 4/1919 Verdugo ..... 135/26

FOREIGN PATENT DOCUMENTS 912897 5/1946 France ..... 135/20 A
4565 12/1937 Japan .
56759 6/1974 Japan .
19952 2/1976 Japan .
8927 12/1979 Japan .

*Primary Examiner*—Harland S. Skogquist
*Attorney, Agent, or Firm*—& Wolters, Ltd. Trexler, Bushnell

[57] ABSTRACT

An umbrella with an oval canopy comprising a center pole (1), a plurality of long main ribs (12), and a plurality of short main ribs (31). The center pole (1) consists of upper and lower poles (1') (1'') slidably fitted. Each long main rib (12) consists of a proximal long main rib (16) and a long distal rib (19) slidably fitted to the proximal long main rib (16) through a slide member (18). Each short main rib (31) consists of a proximal short main rib (35) and a short distal rib (38) slidably fitted to the proximal short main rib (35) through a movable member (37). When opened, the canopy automatically assumes an oval form or substantially oval form, and when closed, the distal ends of the main ribs automatically lie on the same plane, and when compressed, the total length of the closed umbrella is considerably shortened.

16 Claims, 14 Drawing Figures

UMBRELLA WITH OVAL CANOPY

The present invention relates to an umbrella whose canopy is substantially oval when the umbrella is opened.

Most of the conventional umbrellas are so designed that the canopy is round when the umbrella is opened and that the center pole is located at the center of the circle, so that the canopy deviates to the right or left or to front or back depending upon the position of the hand of a person holding the umbrella, thus incurring the possibility that the right or left side or the front or back side of the person putting up the umbrella, or the side to which the canopy deviates, will become wet.

To avoid this situation, there have been proposed various umbrellas so designed that the canopy is substantially oval when the umbrella is opened.

For example, Japanese Utility Model Publication No. 4565/1937 (hereinafter referred to as the reference 1) discloses an umbrella comprising main ribs which are made different in length so that when the umbrella is opened the canopy spreads out to one side so assume a substantially oval shape, short stay ribs pivotally connected to the short main ribs, long stay ribs pivotally connected to the long main ribs, a plurality of hub tubes each having the distal ends of the stay ribs of the same length pivotally connected thereto, the hub tube for the short stay ribs being disposed at the top with the hub tubes for successively longer stay ribs being disposed at successively lower levels, said hub tubes being slidably fitted on the center pole. The presence of the many hub tubes complicates the production and adds to the weight. Further, when the umbrella is closed, the main ribs gathered around the center pole differ in length, which is very unsightly and makes it difficult to use the umbrella, and the umbrella in its closed state is considerably long, causing inconvenience in handling.

An umbrella disclosed in Japanese Utility Model Application Disclosure No. 19952/1976 consists in equalizing the lengths of the stay ribs in the reference 1, using a single hub tube, and making the distal end portions of the long main ribs outwardly foldable. Although this umbrella is simpler in construction and more improved in appearance than the one shown in reference 1, opening or closing the umbrella requires the manual operation of unbending or bending the long main ribs one by one, which is very troublesome in use.

An umbrella disclosed in Japanese Utility Model Publication No. 8927/1979 consists in replacing the plurality of hub tubes in the reference 1 by a single hub tube having vertical slots cut in the outer peripheral surface thereof allowing the pivotal points of the stay ribs to move. Although the number of hubs is reduced to facilitate handling, when the umbrella is closed, as in the reference 1, the main ribs gathered around the center pole differ in length, which is unsightly and makes it difficult to use the umbrella, and the umbrella in its closed state is considerably long. Another disadvantage is that the construction of the hub is complicated, so that the production cost is high.

An umbrella disclosed in Japanese Patent Application Disclosure No. 56759/1974 comprises a canopy which assumes an oval shape when the umbrella is opened, expansible canopy ribs pivotally connected through articulated joints to a canopy crown fixed on the upper end of a center pole, extensible members pivotally connected at their proximal ends to a main hand hub slidably fitted on said center pole on the handle side and at their distal ends to said articulated joints, support members pivotally connected at their distal ends to the intermediate regions of those extensible members which are associated with the longer of said canopy ribs, the proximal ends of said support members being pivotally connected to a first flange fixed on said center pole below said canopy crown, and short support members pivotally connected at their distal ends to the intermediate regions of those extensible members which are associated with the shorter of said canopy ribs, the proximal ends of said short support ribs being pivotally connected to an auxiliary hand hub slidably fitted on said center pole below said first flange.

Although this umbrella is functionally superior to the three types of umbrellas described above, it has a disadvantage that depending upon the sum of the distance between the canopy crown and the first flange, the length of the support ribs, and the length of the extensible members as measured from the pivotal points of the support members to the main hand hub, associated with the longer canopy ribs, and the sum of the length of the extensible members and the length of the canopy ribs as measured from the articulated joints pivotally connected to the extensible members to the articulated joints upon closure of the umbrella, associated with the shorter canopy ribs, it happens that the longer and shorter canopy ribs fail to concurrently unfold when the umbrella is opened, that the opening operation ends with the umbrella being only half opened, making it necessary to bring the umbrella to its full closed state by hand, or that the umbrella cannot be closed such that all the canopy ribs extend parallel to the center pole. Further, no reference has been made to whether or not the umbrella is closed such that the distal ends of all canopy ribs lie on the same plane. In addition, a case is disclosed where the first flange is slidably fitted on the center pole, but in this case also there is some drawback.

Accordingly, it is an object of this invention to provide a novel and improved umbrella with an oval canopy.

A more specific object of this invention is to provide an umbrella so designed that when the umbrella is opened, the canopy automatically assumes an oval shape or a substantially oval shape spreading out to one side from a circle or assume a star shape.

A related object of this invention is to provide an umbrella with an oval canopy so designed that when the umbrella is closed, the distal ends of the main ribs automatically lie on the same plane, presenting an external appearance not differing from that of a conventional umbrella.

A further object of this invention is to provide an umbrella with an oval canopy so designed that when the umbrella is closed and compressed, the total length of the umbrella is considerably shortened so that it can be conveniently carried.

An umbrella with an oval canopy in accordance with this invention comprises:

(A) a center pole consisting of upper and lower center poles slidably fitted with each other; said center pole having an upper hub fixed thereon, and intermediate and lower hubs slidably fitted thereon, and a means in the upper portion thereof for limiting the slide movement of said intermediate hub;

(B) a plurality of long main ribs each consisting of:

(a) a proximal long main rib pivotally connected at its proximal end to said upper hub;

(b) a long distal rib slidably fitted to the distal end of said proximal long main rib through a slide member, said slide member having connected thereto the distal end of a support rib pivotally connected at its proximal end to said lower hub; said support rib having pivotally connected thereto at its middle region the distal end of a stay rib pivotally connected at its proximal end to said intermediate hub;

(c) and a preventive member 15 fixed on said long main rib;

(C) and a plurality of short main ribs each consisting of:

(a) a proximal short main rib pivotally connected at its proximal end to said upper hub, (b) a short distal rib slidably fitted to the distal end of said proximal short main rib through a movable member, said movable member having connected thereto the distal end of a short support rib and pivotally connected at its proximal end to said lower hub and having pivotally connected thereto at its middle region the distal end of an expansible combination stay rib pivotally connected at its proximal end to said intermediate hub, (c) and upper and lower preventive members 43 and 34 fixed on said short main rib.

Other objects, features and advantages of this invention will become more readily apparent upon reading the following detailed description of the illustrated embodiments together with reference to the accompanying drawings wherein:

FIG. 1 is an elevation showing the principal portion of a first embodiment of the umbrella in its opened state, FIG. 1(*a*) being an enlarged view of the slide member and preventive member, and FIG. 1(*b*) being the same view as FIG. 1(*a*) of a varied form.

FIGS. 1(*c*) and 1(*d*) are enlarged views of portions of FIG. 1.

Figure 5A:
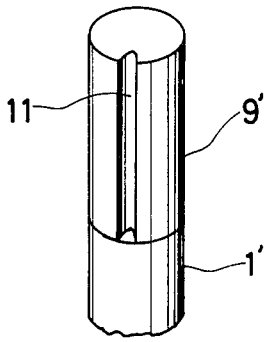
Figure 4A:
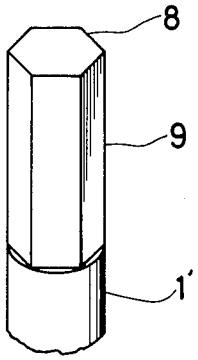
Figure 5B:
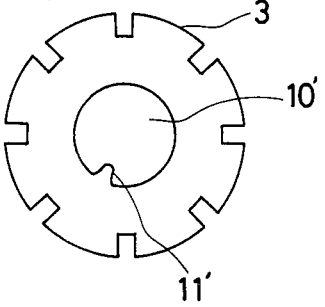
Figure 4B:
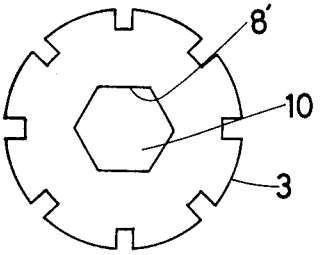

FIGS. 4 and 5 are explanatory views of a limiting means for an intermediate hub, each of FIGS. 4(*a*) and 5(*a*) being a perspective view of the principal portion of an upper center pole, each of FIGS. 4(*b*) and 5(*b*) being a plan view of the intermediate hub.

Figure 6:
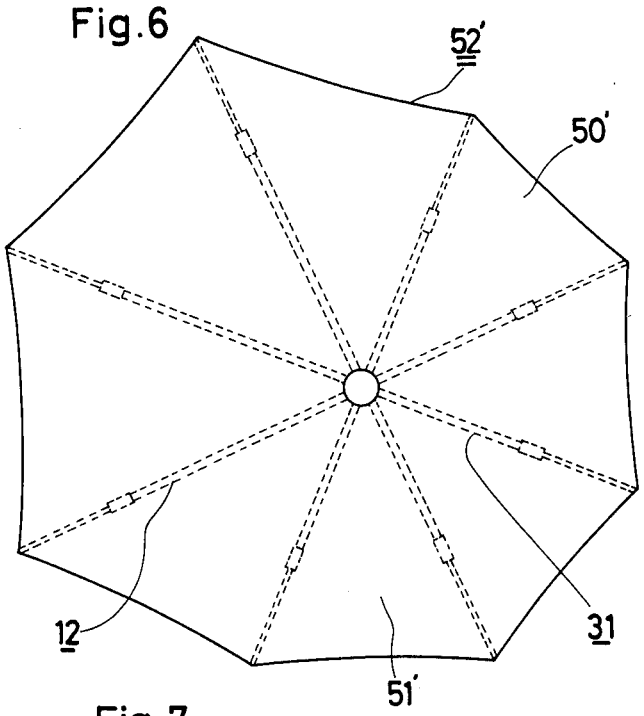
Figure 7:
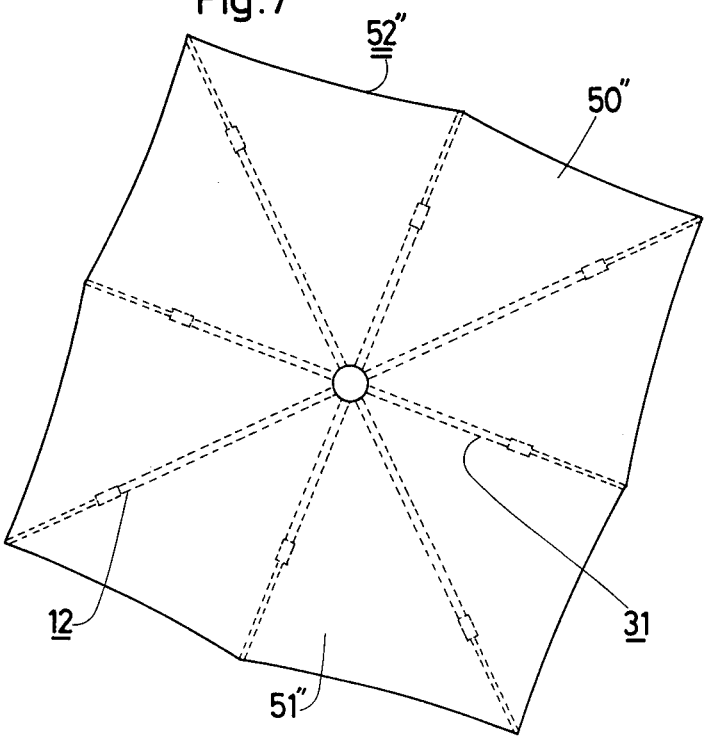

FIGS. 6 and 7 are plan views of an umbrella in its opened state, showing other embodiments of the invention.

A first embodiment of the invention shown in FIGS. 1–5 will now be described.

The numeral 1 denotes a center pole consisting of an upper center pole 1' in the form of a tube having a large inner diameter, and a lower center pole 1'' in the form of a tube or bar having an outer diameter smaller than the inner diameter of the upper center pole 1', said upper and lower center poles being telescoped together so that the assembly is expansible. A locking device similar to one used for a conventional umbrella is provided between the upper and lower center poles so that when the lower center pole 1'' is pushed further into the upper center pole 1' to reduce the length of the center pole 1 to a minimum or when the lower center pole 1'' is outwardly pulled from the upper center pole 1' to increase the length of the center pole 1 to a maximum, the lower center pole 1'' may be locked in the upper center pole 1'.

The upper center pole 1' has an upper hub 2 fixed on the top thereof and an intermediate hub 3 fitted thereon below said upper hub 2 so that the intermediate hub is slidable within a limiting device to be later described. Fixed on the lower end of the lower center pole 1'' is a handle 5 provided with a recess 6 for receiving the distal ends of the umbrella ribs, and a lower hub 4 is slidably fitted on the lower center pole, said lower hub being also slidable on the upper center pole 1'.

A limiting device 7 as shown in FIGS. 4 and 5 is provided between the intermediate hub 3 and the upper center pole 1' so that when the intermediate hub 3 is lowered on the upper center pole 1' over a required distance from the upper hub 2, it will not lower any more. In FIG. 4, the limiting device 7 comprises a fitting portion 9 formed by shaping the upper portion of the upper center pole 1' to a polygon 8 (in the figure, a regular hexagon) in cross section over a required distance, and a fitting portion 10 formed by shaping the inside of the intermediate hub 3 to a polygon 8' in cross section to fit on said fitting portion 9, said intermediate hub 3 being adapted to stop at the lower end of the fitting portion 9. In FIG. 5, the limited device 7 comprises a fitting portion 9' formed by shaping the upper portion of the upper center pole 1' to provide a groove 11 axially extending over a required distance, and a fitting portion 10' formed by forming a ridge 11' on the inside of the intermediate hub 3 adapted to fit in said fitting portion 9', said intermediate hub 3 being adapted to stop at the lower end of the fitting portion 9'.

In the first embodiment described above, the lower center pole 1'' is inserted into the upper center pole 1' of larger inner diameter, but reversely a tube of smaller outer diameter may be used as the upper hub while using a tube with an inner diameter larger than the outer diameter of the upper center pole as the lower center pole, the two tubes being fitted together. In this case, the upper hub would be fixed at the top of the upper center pole while the intermediate hub would be slidably fitted therebelow (but not slidable on the lower center pole), and the lower hub would be slidably fitted on the lower center pole. Since the intermediate hub cannot slide on the lower center pole, it is possible for the front end of the lower center pole to perform the function of the limiting device 7.

Figures 1, 1A, 1B, 1C, 1D:
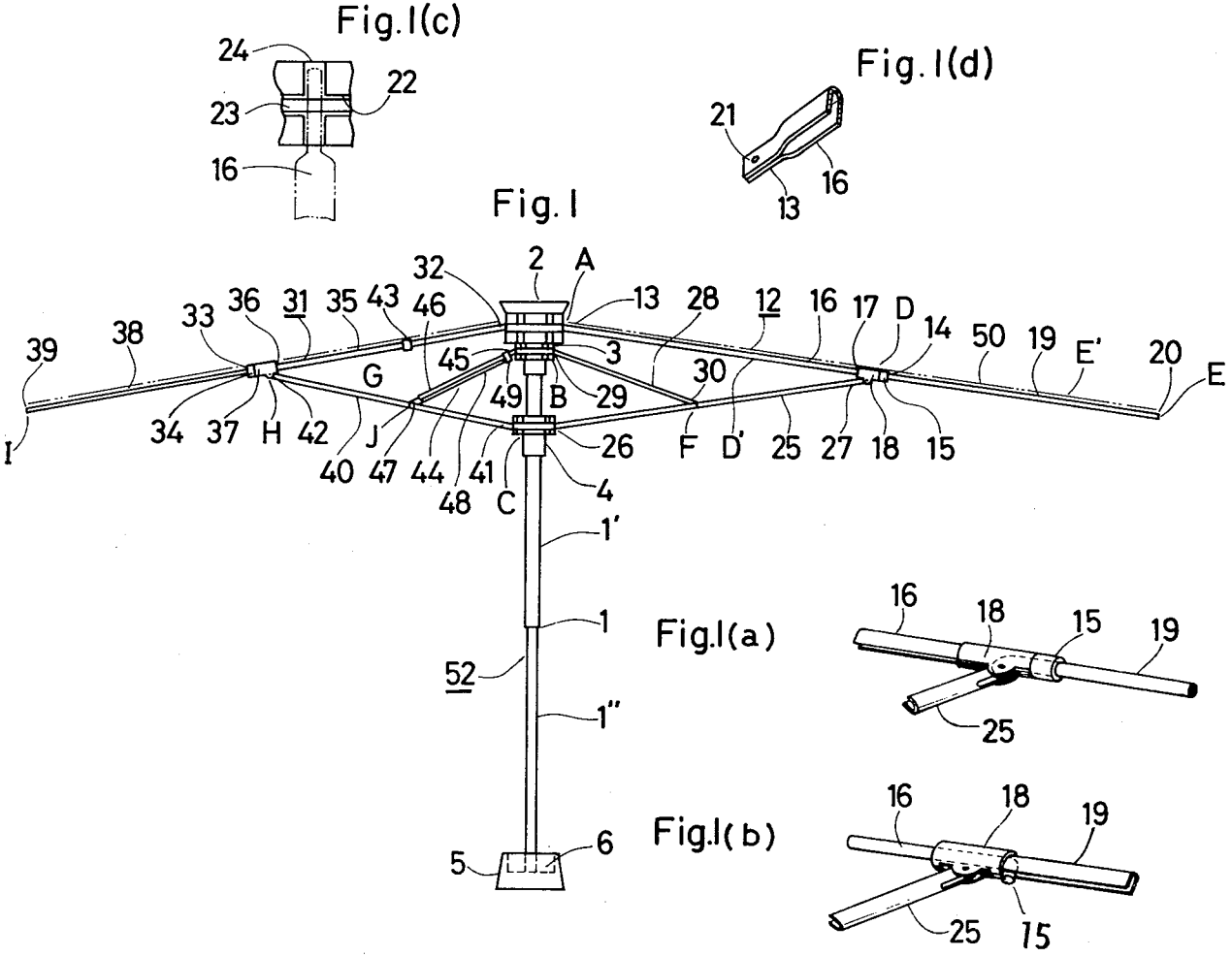

The numeral 12 denotes expansible long main ribs each consisting of a proximal long main rib 16 of required length pivotally connected at its proximal end 13 to the upper hub and having a preventive member 15 fixed at its distal end 14, and a long distal rib 19 of required length slidably fitted in said proximal long main rib 16 at its distal end 14 and connected at its proximal end 17 to a slide member 18 slidably fitted on the proximal long main rib 16. As shown in FIG. 1(*a*), the preventive member may be in the form of a ring, or as shown in FIG. 1(*b*), the preventive member may be in the form of a projection formed by bending the distal end of the proximal long main rib 16. In the case of FIG. 1(*a*), the long distal rib 19 is slidably inserted in the proximal long main rib 16 and pivotally connected at its proximal end 17 to the slide member 18. In the case of FIG. 1(*b*), the proximal long main rib 16 is slidably inserted in the U-grooved long distal rib 19. The numeral 20 denotes the distal ends of the long distal rib 19. The proximal long main ribs 16 are, as best seen in FIG. 1(*c*), held in the upper hub 2 in that a wire 23 fitted in a groove 22 formed in the middle of the outer periphery of the upper hub 2 is passed through holes 21, as best seen in FIG. 1(*d*), formed in the flat portion end of the proximal end 13, so that the proximal long main ribs are turnable around the wire 23 within vertical slots 24 crossing the groove 22.

The numeral 25 denotes support ribs pivotally connected at their proximal ends 26 to the lower hub 4 and at their distal ends 27 to the slide members 18.

The pivotal connection of the proximal ends 26 of the support ribs 25 to the lower hub 4 is effected by the same mechanism as that for pivotally connecting the proximal ends 13 of the proximal long main ribs 16 to the upper hub 2.

The numeral 28 denotes stay ribs pivotally connected at their proximal ends 29 to the intermediate hub 3 by the same mechanism as that for pivotally connecting the proximal ends 13 of the proximal long main ribs 16 to the upper hub 2, and at their distal ends 30 to the middle regions of the support ribs 25.

The numeral 31 denotes expansible short main ribs each consisting of a proximal short main rib 35 shorter than the proximal long main rib 16 pivotally connected at their proximal ends 32 to the upper hub 2 by the same mechanism as that for pivotally connecting the proximal ends 13 of the proximal long main ribs 16, and having a preventive member 34 fixed to its distal end 33, and a short distal rib 38 shorter than the long distal rib 19 and slidably fitted in the proximal short main rib 35 at its distal end 33 and fixed at its proximal end 36 to a movable member 37 slidably mounted on the proximal short main rib 35. Alternatively, similar to the mechanism shown in FIG. 1(*b*), the proximal short main rib 35 may be inserted in the U-grooved short distal rib 38. The numeral 39 denotes the distal ends of the short distal ribs 38.

In addition, it is so arranged that when the long and short main ribs 12 and 31 are shortened to a minimum, they have the same length.

The numeral 40 denotes short support ribs shorter than the support ribs 25 and pivotally connected at their proximal ends 41 to the lower hub 4 by the same mechanism as that for pivotally connecting the proximal ends 26 of the support ribs 25, and at their distal ends 42 to the movable members 37.

The numeral 43 denotes a preventive member for limiting the range of slide movement of the movable member 37.

The numeral 44 denotes combination stay ribs each consisting of a first rib 46 pivotally connected at its proximal end 45 to the intermediate hub 3 by the same mechanism as that for pivotally connecting the proximal ends 29 of the stay ribs 28, and a second rib 48 pivotally connected at its distal end 47 to the middle region of the short support rib 40 and slidably fitted in said first rib 46 to provide for expansion and contraction. The minimum length L of the combination stay ribs 44 (when the umbrella is opened) is less than the length of the stay ribs 28, while their maximum length M (when the umbrella is closed) is such that the sum of the length M and the length $\overline{CJ}$ of the short support ribs 40 measured from the position J to which are attached the distal ends of the combination stay ribs 33 to the position C of the lower hub 4, and the sum of the length $\overline{BF}$ of the stay ribs 25 measured from the position B of the intermediate hub 3 to the position F where the distal ends of the stay ribs 28 are attached to the support ribs 25 plus the length of the support ribs 25 measured from F to C are in the relation $M+\overline{CF} \geqq \overline{BF}+\overline{CF}$.

The numeral 49 denotes slide members slidable with respect to the first ribs 46 but fixed on the second ribs 48.

A plurality of said long main ribs 12 and a plurality of said short main ribs 31 (in FIG. 2, 4 each) are respectively symmetrically arranged around the center pole 1 to form umbrella ribs, and an umbrella cloth 50 is spread and secured between the upper hub 2 and the distal ends 20 and 39 of the long and short main ribs 12 and 31 to serve as a canopy 51, thereby constituting an umbrella 52.

Figure 2:
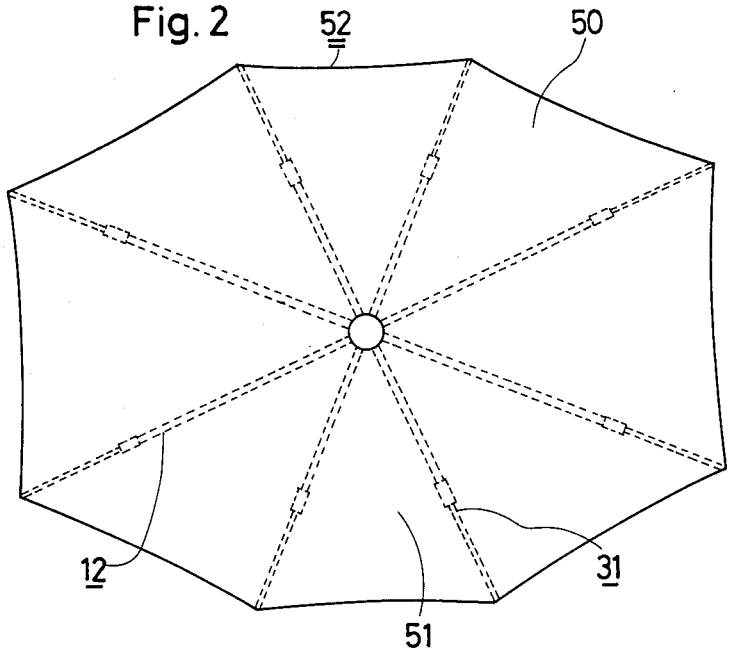
FIG. 2 is a plan view of the umbrella in its opened state.

When opened, this umbrella 52, as shown in FIG. 2 presents an oval shape with the canopy 51 spreading out to opposite sides of the circular form of a conventional umbrella.

The functions of the umbrella 52 will now be described. With the umbrella opened, the intermediate hub 3 is substantially in contact with the upper hub 2, and the lower hub 4 is locked at the predetermined position on the center pole 1 by a locking device similar to one used in a conventional umbrella. The long main ribs 12 are extended to their full length as the slide members 18 are slid from adjacent the position A of the upper hub 2 to the position D of the preventive members 15 to cause the long distal ribs 19 to fully outwardly project from the distal ends 14 of the proximal long main ribs 16. The short main ribs 31 are extended to their full length as the movable members 37 are slid from the position G of the preventive members 43 to the position H of the preventive members 34 to cause the short distal ribs 38 to outwardly project from the distal ends 33 of the proximal short main ribs 35. The combination ribs 44, with their minimum length, connect the short support ribs 40 and the intermediate hub 3.

To close the umbrella from this state, first, the lower hub 4 is unlocked from the center pole 1 and downwardly moved, whereby the long and short main ribs 12 and 31, without changing their lengths, are drawn toward the center pole 1 by the support ribs 25 and short support ribs 40.

As the lower hub 4 is further lowered, the intermediate hub 3, which is lowering along with the lower hub 4, stops at the lower end of the limiting device 7. The position where the intermediate hub 3 stops is determined such that the length $\overline{AH}$ of the proximal short main ribs 35, the length $\overline{CH}$ of the short support ribs 40, the length $\overline{BF}$ of the stay ribs 28, and the length $\overline{CF}$ of the support ribs 25 are in the relation:

$$\overline{AH} + \overline{CH} = \overline{AB} + \overline{BF} + \overline{CF}.$$

In this case, if the sum of the terms on the left-hand side is greater than the sum of the terms on the right-hand side, although the long main ribs 12 can be made parallel and extended along the center pole 1, the short main ribs 31 cannot be made parallel and extended along the center pole 1. In the reverse case, although the short main ribs 31 can be made parallel, the long main ribs 21 cannot.

When the lower hub 4 is further lowered, the intermediate hub 3 remains stopped, and because of the relation $\overline{BF}+\overline{CF}>\overline{L}+\overline{CJ}$, the combination ribs 44 gradually slide to become progressively longer while the short main ribs 31 come to extend along the center pole 1. On the other hand, the stay ribs 28 and support ribs 25 are rapidly brought close to the center pole 1, so that the slide members 18 move toward the upper hub 2, pulling the distal ends 17 of the long distal ribs 19 into the proximal main ribs 16 until a position close to D′ is reached, while moving the distal end position E of the long main ribs 12 to E′; thus, the stay ribs 28 and support ribs 25 and the combination ribs 44 and short support ribs 40 are respectively made parallel and approach the center pole 1, and the long and short main ribs 12 and 31 are also made parallel. At the same time, the length $\overline{AI}$ of the short main ribs 31 measured from A to the distal end position I of the short main ribs 12 becomes approximately equal to the length $\overline{AE'}$ of the long main ribs 12, so that the long and short main ribs are folded along the center pole 1, with their distal ends 20 and 39 lying on the same plane, as shown in FIG. 3(*a*).

Figure 3A:
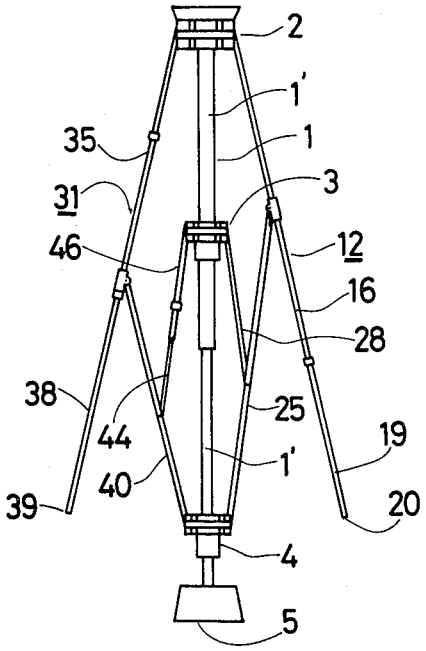
FIG. 3 is an elavation showing the principal portion of the umbrella in its closed state, FIG. 3(*a*) being almost closed state and FIG. 3(*b*) being compressed and shortened state.
Figure 3B:
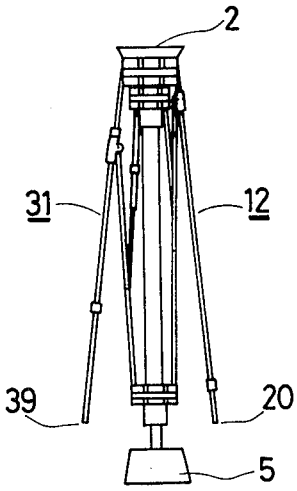

Susequently, as shown in FIG. 3(*b*), when the umrella is compressed by the hands holding the top of the upper hub 2 and the handle 5, the intermediate hub 3 comes almost in contact with the upper hub 2, and the long distal ribs 19 and short distal ribs 38 are completely pushed into the proximal long main ribs 16 and proximal short main ribs 35, so that the long and short main ribs 12 and 31 become shorter, with their distal ends 20 and 39 received in the recess 6 in the handle 5.

To open the completely folded umbrella 52, the top of the upper hub 2 and the handle 5 are held by the hands and pulled away from each other to extend the center pole 1 and the long and short main ribs 12 and 31 to their full lengths. In this case, because of the provision of a device for locking the lower hub 4 on the center pole 1 when the umbrella is folded and for pulling out the lower hub 4 along with the center pole 1 when the latter is extended (such device being also provided in a conventional umbrella), as the lower hub 4 is moved the intermediate hub 3 is also moved and the slide members 18 and movable members 37 slide along the proximal long main ribs 16 and proximal short main ribs 35 to fully extend the long and short main ribs 12 and 31. When the umbrella is held with the upper hub 2 down and the handle 5 up, the long and short main ribs 13 and 31 tend to unfold around the upper hub 2 under their own weight, thus moving the lower hub 4 downwardly. With the movement of the lower hub 4, the combination ribs 44 become progressively shorter and the slide members 18 and movable members 37 also slide more or less toward the upper hub 2. The intermediate hub 3 strikes the upper hub 2, whereby the support ribs 25 and short support ribs 40 push out the long distal ribs 19 and short distal ribs 38 to extend the long and short main ribs 12 and 31 to their maximum lengths; thus, the umbrella is opened with the lower hub 4 locked on the center pole 1.

An embodiment of the invention shown in FIG. 6 will now be described. A plurality of long main ribs 12 and a plurality of short main ribs 31 which are of the slide type constructed in the same manner as in the first embodiment are arranged around an extensible center pole 1 such that the same type of main ribs are successive (in FIG. 6, 5 short main ribs 31 and 3 short main ribs 24) to form umbrella ribs, on which an umbrella cloth 50′ serving as a canopy 51′ is spread and secured, thereby providing an umbrella 52′.

The canopy 51′ spreads out to one side from the circular form of a conventional umbrella to present a substantially oval form.

The function of the umbrella ribs are the same as in the first embodiment.

An embodiment of the invention shown in FIG. 7 will now be described. A plurality of long main ribs 12 and a plurality of short main ribs 31 which are of the slide type constructed in the same manner as in the first embodiment are alternately arranged around an extensible center pole 1 (in FIG. 7, four each) to form umbrella ribs, on which an umbrella cloth 50″ serving as a canopy 51″ are spread and secured, thereby providing an umbrella 52″.

The canopy 51″, unlike those in the first and second embodiments, presents a star form closly resembling a square.

The functions of the umbrella ribs are the same as in the first embodiment.

According to this embodiment, the canopy 51″ presents a shape entirely different from that of a conventional umbrella, providing an ornamental effect. The other functions and merits are the same as in the first and second embodiments.

While preferred embodiments of the invention have been described using specific terms, such description is for illustrative purposes only, and it is to be understood that changes and variations may be made without departing from the spirit and scope of the following claims.

What is claimed is:

1. An umbrella with an oval canopy, comprising:

(A) a center pole consisting of upper and lower center poles slidably fitted with each other; said center pole having an upper hub fixed thereon, and intermediate and lower hubs slidably fitted thereon, and a means in the upper portion thereof for limiting the slide movement of said intermediate hub;

(B) A plurality of long main ribs each consisting of:

(a ) a proximal long main rib pivotally connected at its proximal end to said upper hub;

(b) a long distal rib slidably fitted to the distal end of said proximal long main rib through a slide member, said slide member having connected thereto the distal end of a support rib pivotally connected at its proximal end to said lower hub; said support rib having pivotally connected thereto at its middle region the distal end of a stay rib pivotally connected at its proximal end to said intermediate hub;

(c) and a preventive member 15 fixed on said long main rib;

(C) and a plurality of short main ribs each consisting of:

(a) a proximal short main rib pivotally connected at its proximal end to said upper hub, (b) a short distal rib slidably fitted to the distal end of said proximal short main rib through a movable member, said movable member having connected thereto the distal end of a short support rib and pivotally connected at its proximal end to said lower hub and having pivotally connected thereto at its middle region the distal end of an xpansible combination stay rib pivotally connected at its proximal end to said intermediate hub, (c) and upper and lower preventive members 43 and 34 fixed on said short main rib.

2. An umbrella as set forth in claim 1 wherein the lower center pole is slidably inserted in said upper center pole.

3. An umbrella as set forth in claim 1 wherein the upper pole is slidably inserted in said lower center pole.

4. An umbrella as set forth in one of claims 1 to 3 wherein said limiting means consists of fitting portion 9 formed by shaping the upper portion of said center pole to a square in cross section, and a fitting portion 10 formed by shaping the inside of said intermediate hub to a square in cross section to fit in said fitting portion 9.

5. An umbrella as set forth in one of claims 1 to 3 wherein said limiting means consists of fitting portion 9' formed by shaping the upper portion of said center pole to provide an axially extending groove 11, and a fitting portion 10' formed by forming a ridge 11' on the inside of said intermediate hub to fit in said fitting portion 9'.

6. An umbrella as set forth in claim 1 wherein the long distal rib is slidably inserted in said proximal long main rib.

7. An umbrella as set forth in claim 1 wherein the proximal long main rib is slidably inserted in said long distal rib.

8. An umbrella as set forth in claim 1 wherein said preventive member 15 is a ring.

9. An umbrella as set forth in claim 1 wherein said preventive member 15 is a projection formed by bending the distal end of said proximal long main rib.

10. An umbrella as set forth in claim 1 wherein said short distal rib is slidably inserted in said proximal short main rib.

11. An umbrella as set forth in claim 1 wherein said proximal short main rib is slidably inserted in said short distal rib.

12. An umbrella as set forth in claim 1 wherein said lower preventive member 34 is a ring.

13. An umbrella as set forth in claim 1 wherein the lower preventive member 34 is a projection formed by bending the distal end of said proximal short main rib.

14. An umbrella as set forth in claim 1 wherein a plurality of said long main ribs and a plurality of said short main ribs are respectively symmetrically arranged with respect to said center pole.

15. An umbrella as set forth in claim 1 wherein a plurality of said long main ribs and a plurality of said short main ribs are arranged around said center pole such that the same type of main ribs are successive.

16. An umbrella as set forth in claim 1 wherein a plurality of said long main ribs and a plurality of said short main ribs are arranged around said center pole such that the dissimilar types of main ribs alternate with each other.

* * * * *